US010982308B2

(12) United States Patent
Pinger et al.

(10) Patent No.: US 10,982,308 B2
(45) Date of Patent: Apr. 20, 2021

(54) HOT-DIP GALVANIZATION SYSTEM AND HOT-DIP GALVANIZATION METHOD, IN PARTICULAR FOR MASS PRODUCTION

(71) Applicant: Fontaine Holdings NV, Houthalen (BE)

(72) Inventors: Thomas Pinger, Haltern am See (DE); Lars Baumgürtel, Nottuln (DE)

(73) Assignee: FONTAINE HOLDINGS NV, Houthalen (BE)

( * ) Notice: Subject to any disclaimer, the term of this patent is extended or adjusted under 35 U.S.C. 154(b) by 32 days.

(21) Appl. No.: 16/514,199

(22) Filed: Jul. 17, 2019

(65) Prior Publication Data

US 2019/0338407 A1 Nov. 7, 2019

Related U.S. Application Data

(63) Continuation of application No. 16/083,634, filed as application No. PCT/EP2017/050308 on Jan. 9, 2017.

(30) Foreign Application Priority Data

| | | |
|---|---|---|
| Mar. 9, 2016 | (DE) | 10 2016 002 783.5 |
| Mar. 16, 2016 | (DE) | 10 2016 104 855.0 |
| Apr. 12, 2016 | (DE) | 10 2016 106 662.1 |

(51) Int. Cl.

| | |
|---|---|
| ***C23C 2/06*** | (2006.01) |
| ***C23C 2/30*** | (2006.01) |
| ***C23C 2/00*** | (2006.01) |
| ***C23C 2/02*** | (2006.01) |
| ***C23C 2/14*** | (2006.01) |
| ***C23C 2/26*** | (2006.01) |
| *C23C 2/38* | (2006.01) |

(52) U.S. Cl.

CPC ..... *C23C 2/003* (2013.01); *C23C 2/02* (2013.01); *C23C 2/06* (2013.01); *C23C 2/14* (2013.01); *C23C 2/26* (2013.01); *C23C 2/30* (2013.01); *C23C 2/385* (2013.01)

(58) Field of Classification Search

CPC .... C23C 2/30; C23C 2/02; C23C 2/06; C23C 2/34

See application file for complete search history.

(56) References Cited

U.S. PATENT DOCUMENTS

| | | | |
|---|---|---|---|
| 1,935,087 | A | 11/1933 | Free |
| 2,520,658 | A | 8/1950 | Rheem |
| 2,940,870 | A | 6/1960 | Baldwin |
| 3,063,409 | A | 11/1962 | Turner |
| 3,639,142 | A | 2/1972 | Maxwell |
| 3,701,336 | A | 10/1972 | McConnell |

(Continued)

FOREIGN PATENT DOCUMENTS

| | | |
|---|---|---|
| WO | 9504607 | 2/1995 |

OTHER PUBLICATIONS

Final Office Action, U.S. Appl. No. 16/083,634; dated Dec. 13, 2019.

*Primary Examiner* — Binu Thomas

(74) *Attorney, Agent, or Firm* — Edward E. Sowers; Brannon Sowers & Cracraft PC

(57) ABSTRACT

The invention relates to a system and a method for the hot-dip galvanization of motor-vehicle components, preferably for mass-production hot-dip galvanization of a plurality of identical or similar motor-vehicle components, in particular in batches, preferably for batch galvanization, especially preferably for high-precision hot-dip galvanization.

10 Claims, 6 Drawing Sheets

(56) References Cited

U.S. PATENT DOCUMENTS

| | | | |
|---|---|---|---|
| 4,255,467 | A | 3/1981 | Bounds |
| 6,277,443 | B1 | 8/2001 | Stefanick |
| 2003/0219543 | A1 | 11/2003 | Warichet |
| 2011/0183072 | A1 | 7/2011 | Carroll |
| 2014/0342092 | A1 | 11/2014 | Andreae |

HOT-DIP GALVANIZATION SYSTEM AND HOT-DIP GALVANIZATION METHOD, IN PARTICULAR FOR MASS PRODUCTION

CROSS-REFERENCES TO RELATED APPLICATIONS

This patent application is a continuation of U.S. application Ser. No. 16/083,634, entitled "HOT-DIP GALVANIZATION SYSTEM AND HOT-DIP GALVANIZATION METHOD, IN PARTICULAR FOR MASS PRODUCTION" filed on Sep. 10, 2018, which claims priority to PCT/EP 2017/050308, filed Jan. 9, 2017, and to German Applications DE 10 2016 002 783.5 filed Mar. 9, 2016, DE 10 2016 104 855.0 filed Mar. 16, 2016, and DE 10 2016 106 662.1 filed Apr. 12, 2016, and incorporates all by reference herein, as if each one were independently incorporated in its entirety.

BACKGROUND OF THE INVENTION

The present invention relates to the technical field of the galvanization of iron-based and/or iron-containing components, in particular steel-based and/or steel-containing components (steel components), for the automobile and/or automotive industry, by means of hot dip galvanization.

In particular, the present invention relates to a system and also a method for hot dip galvanizing of automotive components (i.e., of iron-based and/or iron-containing automotive components, in particular steel-based and/or steel-containing automotive components (steel components)), in particular for the large-scale (high-volume) (production-line) hot dip galvanizing of a multiplicity of identical or similar automotive components, in discontinuous operation (known as batch galvanizing).

Metallic components of any kind consisting of iron-containing material, and in particular components made of steel, often require application-related an efficient protection against corrosion. In particular, components consisting of steel for motor vehicles (automotive), such as for example automobiles, trucks, utility vehicles and so on, require efficient protection against corrosion that withstands even long-term exposures.

In this connection it is known practice to protect steel-based components against corrosion by means of galvanizing (zinc coating). In galvanizing, the steel is provided with a generally thin zinc coat in order to protect the steel against corrosion. There are various galvanizing methods that can be used to galvanize components consisting of steel, in other words to coat them with a metallic covering of zinc, including in particular the methods of hot dip galvanizing, zinc spraying (flame spraying with zinc wire), diffusion galvanizing (Sherardizing), electrogalvanizing (electrolytic galvanizing), nonelectrolytic zinc coating by means of zinc flake coatings, and also mechanical zinc coating. There are great differences between the aforesaid zinc coating and galvanizing methods, in particular with regard to their implementation, but also to the nature and properties of the zinc layers and/or zinc coatings produced.

Probably the most important method for corrosion protection of steel by means of metallic zinc coatings is that of hot dip galvanizing. Thereby steel is immersed continuously (e.g. coil and wire) or in piecemeal (e.g. components) in a heated tank comprising liquid zinc at temperatures from around 450° C. to 600° C. (melting point of zinc: 419.5° C.), thus forming on the steel surface a resistant alloy layer of iron and zinc and, over that, a very firmly adhering pure zinc layer.

In the context of hot dip galvanizing, a distinction is made between discontinuous, batch galvanizing (cf., e.g. DIN EN ISO 1461) and continuous coil galvanizing (DIN EN 10143 and DIN EN 10346). Both batch galvanizing and strip galvanizing are normalized and/or standardized processes. Strip-galvanized steel is a precursor and/or intermediate (semifinished product) which, after having been galvanized, is processed further by means in particular of forming, punching, trimming, etc., whereas components to be protected by batch galvanizing are first fully manufactured and only thereafter subjected to hot dip galvanizing (thus providing the components with all-round corrosion protection). Batch galvanizing and strip galvanizing also differ in terms of the thickness of the zinc layer, resulting in different durations of protection. The zinc layer thickness on strip-galvanized sheets is usually not more than 20 to 25 micrometers, whereas the zinc layer thicknesses on batch-galvanized steel parts are customarily in the range from 50 to 200 micrometers and even more.

Hot dip galvanizing affords both active and passive corrosion protection. The passive protection is through the barrier effect of the zinc coating. The active corrosion protection occurs due to the cathodic activity of the zinc coating. Relative to more noble metals of the electrochemical series, such as for example iron, zinc serves as a sacrificial anode, protecting the underlying iron from corrosion until the zinc itself is corroded entirely.

The so-called batch galvanizing according to DIN EN ISO 1461 is used for the hot dip galvanizing of usually relatively large steel components and constructions. Thereby steel-based blanks or completed workpieces (components) being pretreated and then immersed into the zinc melt bath. The immersion allows, in particular, even internal faces, welds, and difficult-to-access locations on the components or workpieces for galvanizing to be easily reached.

Conventional hot dip galvanizing is based in particular on the dipping of iron and/or steel components into a zinc melt to form a zinc coating or zinc covering on the surface of the components. In order to ensure the adhesiveness, the imperviosity, and the unitary nature of the zinc coating, there is generally a requirement beforehand for thorough surface preparation on the components to be galvanized, customarily comprising a degrease with subsequent rinsing operation, a subsequent acidic pickling with downstream rinsing operation, and, finally, a flux treatment (i.e. so-called fluxing), with a subsequent drying operation.

The typical process sequence of conventional batch galvanizing by hot dip galvanization customarily takes the following form: in the case of batch galvanizing of identical or similar components (e.g. series production of automotive components), for reasons of process economy and economics, they are typically collated and/or grouped for the entire procedure (this being done in particular by means of a common goods carrier, configured for example as a cross-beam or rack, or of a common mounting and/or attachment device for a multiplicity of these identical and/or similar components). For this purpose, a plurality of components is attached on the goods carrier via holding means, such as for example slings, tie wires or the like. The components in the grouped state are subsequently supplied via the goods carrier to the subsequent treatment steps and/or stages.

First of all, the component surfaces of the grouped components are subjected to degreasing, in order to remove residues of greases and oils, wherein degreasing agents in the form, customarily, of aqueous alkaline or acidic degreasing agents are employed. Cleaning in the degreasing bath is followed customarily by a rinsing operation, typically by immersion into a water bath, in order to prevent degreasing agents being entrained with the galvanization material into the next operational step of pickling, this being especially important in particular in the case of a switch from alkaline degreasing to an acidic pickling.

The next step is that of pickling treatment (pickling), which serves in particular to remove homologous impurities, such as for example rust and scale from the steel surface. Pickling is customarily accomplished in dilute hydrochloric acid, with the duration of the pickling procedure being dependent on factors including the contamination status (e.g. degree of rusting) of the galvanization material, and on the acid concentration and temperature of the pickling bath. In order to prevent and/or minimize entrainments of residual acid and/or residual salt with the galvanization material, the pickling treatment is customarily followed by a rinsing operation (rinse step).

This is followed by what is called fluxing (treatment with flux), in which the previously degreased and pickled steel surface with what is called a flux, typically comprising an aqueous solution of inorganic chlorides, most frequently with a mixture of zinc chloride ($ZnCl_2$) and ammonium chloride ($NH_4Cl$). On the one hand, the task of the flux is to carry out a final intensive fine-purification of the steel surface prior to the reaction of the steel surface with the molten zinc, and to dissolve the oxide skin on the zinc surface, and also to prevent renewed oxidation of the steel surface prior to the galvanizing procedure. On the other hand, the flux raises the wetting capacity between the steel surface and the molten zinc. The flux treatment is customarily followed by a drying operation in order to generate a solid film of flux on the steel surface and to remove adhering water, thus avoiding subsequently unwanted reactions (especially the formation of steam) in the liquid zinc dipping bath.

The components pretreated in the manner indicated above are then subjected to hot dip galvanizing by being immersed into the liquid zinc melt. In the case of hot dip galvanizing with pure zinc, the zinc content of the melt according to DIN EN ISO 1461 is at least 98.0 wt %. After the galvanization material has been immersed into the molten zinc, it remains in the zinc melting bath for a sufficient time period, in particular until the galvanization material has assumed its temperature and has been coated with a zinc layer. The surface of the zinc melt is typically cleaned to remove, in particular, oxides, zinc ash, flux residues and the like, before the galvanization materials is then extracted from the zinc melt again. The component hot dip galvanized in this way is then subjected to a cooling process (e.g. in the air or in a water bath). Lastly, the holding means for the component, such as for example slings, tie wires or the like are removed. Subsequent to the galvanizing operation, there is customarily a reworking or aftertreatment operation, which in some cases is involved. Here excess zinc bath residues, particularly what are called drip edges and streaks of the zinc solidifying on the edges, and also oxide or ash residues adhering to the component, are removed as far as possible.

One criterion of the quality of hot dip galvanization is the thickness of the zinc coating in μm (micrometers). The standard DIN EN ISO 1461 specifies the minimum values of the requisite coating thicknesses to be afforded, depending on thickness of material, in batch galvanizing. In actual practice, the coat thicknesses are well above the minimum coat thicknesses specified in DIN EN ISO 1461. Generally speaking, zinc coatings produced by batch galvanizing have a thickness in the range from 50 to 200 micrometers or even more.

In the galvanizing process, as a consequence of mutual diffusion between the liquid zinc and the steel surface, a coating of iron/zinc alloy layers with differing compositions is formed on the steel part. On withdrawal of the hot dip galvanized articles, a layer of zinc—also referred to as pure zinc layer—remains adhering to the uppermost alloy layer, this layer of zinc having a composition corresponding to that of the zinc melt. On account of the high temperatures associated with the hot dipping, a relatively brittle layer is thus formed initially on the steel surface, this layer being based on an alloy (mixed crystals) between iron and zinc, with the pure zinc layer only being formed atop that layer. While the relatively brittle iron/zinc alloy layer does improve the strength of adhesion to the base material, it also hinders the formability of the galvanized steel. Greater amounts of silicon in the steel, of the kind used in particular for the so-called calming of the steel during its production, result in increased reactivity between the zinc melt and the base material and, consequently, in strong growth of the iron/zinc alloy layer. In this way, relatively high overall layer thicknesses are formed. While this does enable a very long period of corrosion protection, it nevertheless also raises the risk, in line with increasing thickness of the zinc layer, that the layer will flake off under mechanical exposure, particularly sudden, local exposures, thereby destroying the corrosion protection effect.

In order to counteract the above-outlined problem of the incidence of the rapidly growing, brittle and thick iron/zinc alloy layer, and also to enable relatively low layer thicknesses in conjunction with high corrosion protection in the case of galvanizing, it is known practice from the prior art additionally to add aluminum to the zinc melt or to the liquid zinc bath. For example, by adding 5 wt % of aluminum to a liquid zinc melt a zinc/aluminum alloy is produced that has a melting temperature lower than that of pure zinc. By using a zinc/aluminum melt (Zn/Al melt) and/or a liquid zinc/aluminum bath (Zn/Al bath), on the one hand it is possible to realize much lower layer thicknesses for reliable corrosion protection (generally of below 50 micrometers); on the other hand, the brittle iron/tin alloy layer is not formed, because the aluminum—without being tied to any particular theory—initially forms, so to speak, a barrier layer on the steel surface of the component in question, with the actual zinc layer then being deposited on this barrier layer. Components hot dip galvanized with a zinc/aluminum melt are therefore readily formable, but nevertheless—in spite of the significantly lower layer thickness by comparison with conventional hot dip galvanizing with a quasi-aluminum-free zinc melt—exhibit improved corrosion protection qualities. Relative to pure zinc, a zinc/aluminum alloy used in the hot dip galvanizing bath exhibits enhanced fluidity qualities. Moreover, zinc coatings produced by hot dip galvanizing carried out using such zinc/aluminum alloys have a greater corrosion resistance (from two to six times better than that of pure zinc), enhanced shapability, and improved coatability relative to zinc coatings formed from pure zinc. This technology, moreover, can also be used to produce lead-free zinc coatings.

A hot dip galvanizing method of this kind using a zinc/aluminum melt and/or using a zinc/aluminum hot dip galvanizing bath is for example known, for example, from WO 2002/042512 A1 and the relevant equivalent publications to this patent family (e.g., EP 1 352 100 B1, DE 601 24 767 T2 and US 2003/0219543 A1). Also disclosed therein are suitable fluxes for the hot dip galvanizing by means of zinc/aluminum melt baths, since flux compositions for zinc/aluminum hot dip galvanizing baths are different to those for conventional hot dip galvanizing with pure zinc. With the method disclosed therein it is possible to generate corrosion protection coatings having very low layer thicknesses (generally well below 50 micrometers and typically in the range from 2 to 20 micrometers) and having very low weight in conjunction with high cost-effectiveness, and accordingly the method described therein is employed commercially under the designation of microZINQ® process.

In the batch hot dip galvanizing of components in zinc/aluminum melt baths, in particular in the case of large-scale batch hot dip galvanizing of a multiplicity of identical or similar components (e.g., large-scale batch hot dip galvanizing of automotive components and/or in the automobile industry), because of the more difficult wettability of the steel with the zinc/aluminum melt and also the low thickness of the zinc coverings and/or zinc coatings, there is a problem with always subjecting the identical and/or similar components to identical operating conditions and operating sequences in an economic process sequence, in particular with implementing high-precision hot dip galvanizing reliably and reproducibly in a manner which affords identical dimensional integrities for all identical or similar components. In the prior art—as well as by costly and inconvenient pretreatment, especially with selection of specific fluxes—this is typically accomplished in particular by special process control during the galvanizing procedure, such as, for example, extended immersion times of the components into the zinc/aluminum melt, since only in this way it is ensured that there are no defects in the relatively thin zinc coatings, or no uncoated or incompletely coated regions.

In order to make the processing sequence economical for the known batch hot dip galvanizing of identical and/or similar components, more particularly in the case of large-scale batch hot dip galvanizing, and to ensure an identical process sequence, the prior art collates or groups a multiplicity of the identical or similar components for galvanizing on a common goods carrier or the like, for example, and guides them in the grouped state through the individual process stages, and in particular the galvanizing bath.

The known batch hot dip galvanizing, however, has various disadvantages. If the articles on the goods carrier are hung in two or more layers, and especially if the immersion movement of the goods carrier is the same as the emersion movement, the components and/or regions of components inevitably do not spend the same time in the zinc melt. This results in different reaction times between the material of the components and of the zinc melt, and, consequently, in different zinc layer thicknesses on the components. Furthermore, in the case of components with high temperature sensitivity, in particular in the case of high-strength and ultra high-strength steels, such as for example for spring steels, chassis and bodywork components, and press-hardened forming parts, differences in residence times in the zinc melt affect the mechanical characteristics of the steel. With a view to ensuring defined characteristics on the part of the components, it is vital that defined operating parameters are observed for each individual component.

Furthermore, on withdrawal of the components from the zinc melt, it is inevitable that the zinc will run and will drip from edges and angles of the components. This produces zinc bumps on the component. Eliminating these zinc bumps subsequently, which is normally a manual task, represents a considerable cost factor, particularly if the piece numbers being galvanized are high and/or if the tolerance requirements to be observed are exacting. With a fully laden goods carrier, it is generally not possible to reach all of the components and there individually remove the zinc bumps directly at the site of galvanizing. Customarily, after galvanizing, the galvanized components have to be taken off from the goods carrier, and must be manually examined and worked on individually, in a very costly and inconvenient operation.

Moreover, in the case of the known batch hot dip galvanizing, the immersion and emersion (removal) movement of the goods carrier into and out of the galvanizing bath takes place at the same location. The inevitable occurrence of zinc ash, as a reaction product of the flux and the zinc melt, after the immersion of the components, this ash accumulating on the surface of the zinc bath, makes it absolutely necessary, before emersion, for the zinc ash to be removed from the surface by drawing off or washing away, in order to prevent it adhering to the galvanized components on withdrawal, to create as little contamination as possible on the galvanized component. In view of the large number of components in the zinc bath and in view of the comparatively poor accessibility of the surface of the galvanizing bath, removing the zinc ash from the bath surface proves generally to be a very costly and inconvenient, and in some cases problematical, operation. On the one hand, there is a delay to the operation with a reduction in productivity at the same time within the removal of the zinc ash from the surface of the galvanizing bath and, on the other hand, there is a source of defects in relation to the quality of galvanization of the individual components.

Ultimately, with the known batch hot dip galvanizing, contaminants and zinc bumps remain on the galvanized components and must be removed by manual afterwork. This afterwork is generally very costly and time-consuming. In this regard it should be noted that afterwork here refers not only to the cleaning and/or remediation, but also, in particular, to the visible inspection. For process-related reasons, all of the components are subject to a risk of contaminants adhering or zinc bumps being present and requiring removal. Accordingly, all of the components must be looked at individually. This inspection alone, without any subsequent steps of work that may be necessary, represents a very high cost factor, in particular in the large-scale production sector with a very large number of components to be inspected and with very high-quality requirements.

BRIEF SUMMARY OF THE INVENTION

The aforementioned problems arise in particular in connection with the large-scale (high-volume) production of automotive components. With these components, which are produced in large numbers, it is very important to comply with precisely mandated characteristic values. In this connection, defective hot dip galvanizing has very sustained consequences.

The problem addressed by the present invention is therefore that of providing a system and a method for batch galvanizing iron-based or iron-containing automotive components, is particular steel-based or steel-containing automotive components (steel components), by means of hot dip galvanizing in a zinc/aluminum melt (i.e. in a liquid zinc/aluminum bath), preferably for the large-scale hot dip galvanizing of a multiplicity of identical or similar automotive components, in which the disadvantages outlined above for the prior art are to be at least largely avoided or else at least diminished.

In particular, the intention is to provide a system and a method which, relative to conventional hot dip galvanizing systems and methods, enable improved operational economics and a more efficient, and especially more flexible, operating sequence.

In order to solve the problem outlined above the present invention—according to a first aspect of the present invention—proposes a system for hot dip galvanizing; further embodiments, especially particular and/or advantageous embodiments, of the system of the invention are disclosed.

The present invention further relates—according to a second aspect of the present invention—to a method for hot dip galvanizing; further embodiments, especially particular and/or advantageous embodiments, of the method of the invention are disclosed.

With regard to the observations hereinafter, it is clear that embodiments, forms of implementation, advantages and the like which are set out below in relation to only one aspect of the invention, in order to avoid repetition, shall of course also apply accordingly in relation to the other aspects of the invention, without any special mention of this being needed.

For all relative and/or percentage weight-based data stated hereinafter, especially relative quantity or weight data, it should further be noted that within the scope of the present invention they are to be selected by the skilled person in such a way that in total, including all components and/or ingredients, especially as defined hereinbelow, they always add up to or total 100% or 100 wt %; this, however, is self-evident to the skilled person.

In any case, the skilled person is able—based on application or consequent on an individual case—to depart, when necessary, from the range data recited hereinbelow, without departing the scope of the present invention.

It is the case, moreover, that all value and/or parameter data stated below, or the like, can in principle be ascertained or determined using standardized or normalized or explicitly specified methods of determination or otherwise by methods of measurement or determination that are familiar per se to the person skilled in this field.

This having been established, the present invention will now be elucidated below in detail.

DETAILED DESCRIPTION OF THE INVENTION

Figure 1:
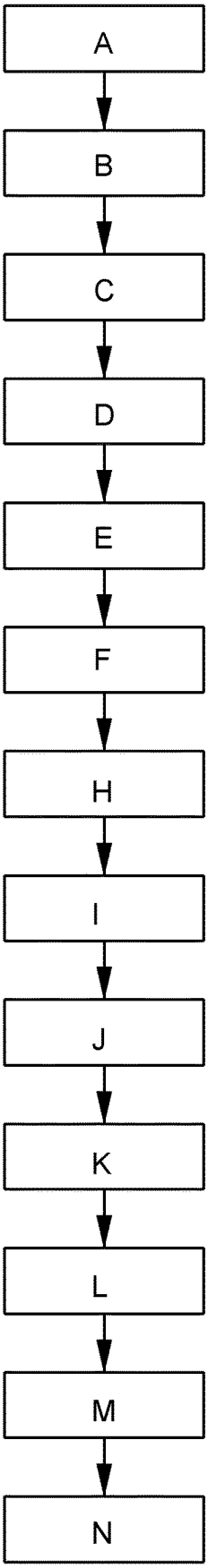
FIG. 1 shows a schematic sequence of the individual stages of the method of the invention.

The invention relates to a system for the hot dip galvanizing of automotive components, preferably for the large-scale (high-volume) hot dip galvanizing of a multiplicity of identical or similar automotive components, especially in discontinuous operation, preferably for batch galvanizing, in particular for high-precision hot dip galvanizing, having a hot dip galvanizing device for hot dip galvanizing the automotive components, where the hot dip galvanizing device comprises a galvanizing bath containing a zinc/aluminum alloy in liquid melt form.

In accordance with the invention, in a system of the aforesaid kind, the object of the invention is achieved in that a handling device is provided for the preferably automated supplying, immersing, and emersing (removing) of a separated (isolated) and singled out component to, into, and from the galvanizing bath, comprising the zinc/aluminum alloy in liquid melt form, of the hot dip galvanizing device.

In accordance with the method, the invention accordingly concerns a method for hot dip galvanizing automotive components, preferably for large-scale (high-volume) galvanizing a multiplicity of identical or similar automotive components, especially in discontinuous operation, preferably for batch galvanizing are subjected to hot dip galvanizing in a galvanizing bath containing a zinc/aluminum alloy in liquid melt form.

In accordance with the invention, in the aforesaid method, during the hot dip galvanizing, the automotive components in the separated and singled out state, preferably automated, are supplied to the galvanizing bath, immersed therein, and subsequently emersed (removed) therefrom.

As a result, the invention differs from the prior art in that the automotive components to be galvanized as part of a large-scale hot dip galvanizing are supplied in the separated and singled out state to the galvanizing bath of the zinc/aluminum alloy. This measure, which at first glance appears to be uneconomic and entailing operational delay in a large-scale production process, in comparison to a grouped or simultaneous galvanizing of a plurality of automotive components, has surprisingly proven particularly preferable for the production of automotive components hot dip galvanized with high precision.

On the basis of economic aspects, the solution according to the invention was initially shunned, since in the prior-art batch galvanizing operation, depending on size and weight, automotive components numbering in some cases several hundred are suspended from a goods carrier and galvanized simultaneously and jointly. Separating (isolating) and singling the automotive components from the goods carrier ahead of galvanizing and galvanizing them in the separated and singled out state, in the first instance, therefore, causes a considerable increase in the time duration of the galvanizing operation itself.

However, in connection with the invention it has been recognized that specifically in the case of automotive components, in particular those made of high-strength and ultra high-strength steels, which are temperature-sensitive, there is a need for targeted and optimized handling during the actual galvanizing operation. In the case of individual galvanizing in connection with the system of the invention and/or the method of the invention, it is readily possible to ensure that the automotive components are each subject to identical operating parameters. For sprung steels or for chassis and bodywork components consisting of high-strength and ultra high-strength steels particularly, such as for example press-hardened forming parts, this plays a considerable part. Through the separation (isolation) and singling of the automotive components for galvanizing it is possible for the reaction times between the steel and the zinc melt to be the same in each case. The ultimate result of this is a constant zinc layer thickness. Moreover, as a result of the galvanization, the characteristic values of the automotive components are influenced identically, since the invention ensures that the automotive components are each exposed to identical operating parameters.

A further, considerable advantage of the invention comes about from the fact that with the separation (isolation) and singling according to the invention, each automotive component can be manipulated and treated precisely, by means, for example, of specific rotational and steering movements of the automotive component during extraction from the melt. As a result, the afterworking cost and complexity can be reduced significantly or even in some cases avoided entirely. The invention affords the possibility, moreover, that zinc ash accumulations can be significantly reduced and, in some cases, even avoided. This is possible because the process according to the invention can be controlled in such a way that an automotive component for galvanizing, in the separated and singled out state, after having been immersed, is moved away from the immersion site and moved toward a site remote from the immersion site. This is followed by emersion. While the zinc ash rises in the region of the immersion site and is located on the surface of the immersion site, there are few residues of zinc ash, or none, at the emersion site. As a result of this specific technique, zinc ash accumulations can be considerably reduced or even avoided.

In connection with the present invention it has been determined that, taking account of the afterwork sometimes no longer necessary in the case of the invention, the overall production time associated with the manufacture of galvanized automotive components can in fact be reduced relative to the prior art, and hence that the invention, ultimately, affords a higher productivity, more particularly because the manual afterworking in the prior art is very time-consuming.

A further system-based advantage associated with separated and singled out galvanizing is that the galvanizing vessel required need not be broad and deep, but instead only narrow. This reduces the surface area of the galvanizing bath, which in that way can be shielded more effectively, allowing a critical reduction in the radiation losses.

All in all, by means of the invention with the separated and singled out galvanizing, resulting automotive components have higher quality and cleanliness on the surface; the automotive components as such have each been subjected to identical operating conditions and therefore possess the same characteristic component values. From an economic standpoint as well, the invention affords economic advantages over the prior art, since the production time can be reduced by up to 20%, taking account of the afterworking which is no longer necessary or in some cases is greatly limited.

Device-related, the system of the invention, in addition to the hot dip galvanizing device and the handling device, preferably comprises a series of further devices upstream and/or downstream of the actual hot dip galvanizing or hot dip galvanizing device, respectively. The system of the invention preferably comprises a conveying device and/or a degreasing device and/or a surface working device and/or a flux application device and/or at least one rinsing device and/or a drying device and/or a quenching device and/or an aftertreating device. The aforesaid devices will be addressed in detail below.

The conveying device comprises at least one goods carrier for conveying or transporting an automotive component or group of automotive components to be fastened on the goods carrier. Moreover, the conveying device may also comprise a plurality of conveying means with identically or differently configured goods carriers on each of which it is possible to fasten either a separated and singled out automotive component or else a group of automotive components. The conveying device is therefore provided for conveying a separated and singled out automotive component and/or a group of automotive components to the individual aforesaid devices, particularly the degreasing device and/or surface treating device, more particular pickling device, and/or the flux application device and/or the drying device. Furthermore, the conveying device may also be provided and configured for conveying or transporting automotive components in the separated and singled out or grouped state to the cooling device and/or aftertreating device.

Furthermore, the system of the invention preferably comprises a degreasing device for degreasing the automotive components. The degreasing device may in principle be decentralized, and hence need not necessarily be located in the same compartment or building as the other aforesaid devices. Nevertheless, a decentralized degreasing device also belongs to the system of the invention. In the degreasing device, the automotive components can be degreased as a group, i.e., in the grouped state, or else in the separated and singled out state. The transport of the automotive components to the degreasing device and away from it is accomplished preferably via the aforesaid conveying device.

Furthermore, the system of the invention preferably comprises a surface working device for the chemical, more particularly wet-chemical, and/or mechanical surface treatment of the automotive components. The surface treating device is configured more particularly as a pickling device for pickling the surface of the automotive components. Pickling of the automotive components may take place in the separated and singled out or in the grouped state. The transport of the automotive components in the separated and singled out or grouped state to the surface treating device and away from it is accomplished preferably via the aforesaid conveying device.

The system of the invention, moreover, preferably comprises a flux application device for the application of flux to the surface of the automotive components. Application of flux to the automotive components may be carried out in the separated and singled out state of the automotive components or else in the grouped state with a plurality of further automotive components at the same time. The transport or conveying of the automotive components, whether in the separated and singled out state or else in the grouped state, to the flux application device and away from it is accomplished preferably via the conveying device, in which case the automotive components are fastened—separately and singled out or grouped—on the goods carrier of the conveying device.

Furthermore, the system of the invention preferably comprises a drying device subsequent to the flux application device, so that the flux, following application to the surface of the automotive components, is dried. This prevents liquid being entrained from the flux solution into the galvanizing bath.

In particular, the system of the invention is configured such that the aforesaid devices are disposed in the sequence identified below in relation to the operational direction:

- the optionally decentralized degreasing device for degreasing the automotive components in the separated and singled out or grouped state of the automotive components,
- the surface treating device, more particularly pickling device, for the chemical, more particularly wet-chemical, and/or mechanical surface treatment of the automotive components, preferably for the pickling of the surface of the automotive components in the separated and singled out or grouped state of the automotive components, the flux application device for application of flux to the surface of the automotive components in the separated and singled out or grouped state of the automotive components, the drying device for drying the flux applied to the surface of the automotive components, and the hot dip galvanizing device for hot dip galvanizing the automotive components in the separated and singled out state.

In the case of the invention it is possible, after an initial grouping of the components via the and/or on the goods carrier, to carry out separation and singling after the surface treatment or after the application of flux.

Device-related, the separation and singling of the components from the goods carrier via the handling device is then provided subsequent to the degreasing or subsequent to the surface treatment, more particularly pickling, or subsequent to the application of flux.

In trials conducted, it was found, from the standpoint of costs versus benefits, that it is most useful for the components to be separated and singled out from the goods carrier after the application of flux, and hence for the handling device to be located between the hot dip galvanizing device and the flux application device. With this embodiment of the invention, the degreasing, the surface treatment, and the application of the flux take place in the grouped state of the components, with only the galvanizing being performed in the separated and singled out state.

In accordance with the apparatus, for a preferred embodiment of the invention, provision is made for the handling device to have at least one handling means disposed between the flux application device and the hot dip galvanizing device. In that case this handling means is preferably configured such that it takes one of the automotive components from the group of automotive components and subsequently supplies said component to the hot dip galvanizing device for individual hot dip galvanizing. The handling means here may take off or withdraw the automotive component directly from the goods carrier, or else may take the automotive component from the group of automotive components already deposited by the goods carrier. Here it is understood that in principle it is also possible for there to be more than one handling means, in other words that a plurality of separated and singled out automotive components are hot dip galvanized simultaneously in the respectively separated and singled out state. In this connection, then, it is also understood that at least the galvanizing operation on the separated and singled out components is carried out identically, even if automotive components from different handling means are guided simultaneously or with a time stagger and independently of one another through the hot dip galvanizing device or the galvanizing bath.

In the case of an alternative embodiment of the system of the invention and of the associated method, the handling means, while being configured so as to take one of the automotive components from the group of automotive components, nevertheless does not supply the automotive component it has taken directly to the galvanizing stage. The handling means may transfer the automotive component, taken from the group of automotive components, to—for example—a conveying system belonging to the handling device, for example an goods carrier or a monorail track, via which the separated and singled out automotive component is then galvanized in the separated and singled out state. Ultimately, in terms of system, in this embodiment the handling device comprises at least two handling means, namely a first handling means that performs the separation and singling of the automotive components from the group of automotive components, and at least one second handling means, in the manner of a conveying system, for example, which then guides the separated and singled out automotive component through the galvanizing bath.

In the case of a further, preferred embodiment of the invention, the handling means is configured such that a separated and singled out automotive component is immersed into an immersion region of the bath, then moved from the immersion region to an adjacent emersion region, and is subsequently emersed in the emersion region. As already observed above, zinc ash occurs at the surface of the immersion region, as a reaction product of the flux with the zinc melt. By moving the automotive component immersed into the zinc melt from the immersion region toward the emersion region, there is little or no zinc ash at the surface of the emersion region. In this way, the surface of the emersed galvanized automotive component remains free or at least substantially free from zinc ash accumulations. Here it is understood that the immersion region is adjacent to the emersion region, in other words relating to regions of the galvanizing bath that are spatially separate from one another and in particular do not overlap.

In the case of one preferred embodiment of the aforesaid concept of the invention, moreover, provision is made for the automotive component after immersion to remain in the immersion region of the galvanizing bath at least until the reaction time between the automotive component surface and the zinc/aluminum alloy of the galvanizing bath is at an end. This ensures that the zinc ash, which moves upward within the melt, spreads out only on the surface of the immersion region. The automotive component can be moved subsequently into the emersion region, which is substantially free from zinc ash, and can be emersed there.

In trials conducted in connection with the invention, it was found that it is useful if the automotive component spends between 20% to 80%, preferably at least 50%. of the galvanizing duration in the region of the immersion region, and only thereafter is moved into the emersion region. From a technical system standpoint, this means that the handling device and/or the one or more associated handling means are, by corresponding control, designed and, as and when necessary, harmonized with one another in such a way that the aforesaid method sequence can be carried out without problems.

Particularly in the case of automotive components made from temperature-sensitive steels, and in the case of customer-specific requirements for automotive components with maximally identical product properties, provision is made, in accordance with the system and the method, for the handling means or the handling device to be configured such that all automotive components in the separated and singled out state are guided in an identical way, more particularly with identical movement, in identical arrangement and/or with identical time, through the galvanizing bath. Ultimately this can easily be achieved by corresponding control of the handling device and/or of the at least one assigned handling means. As a result of the identical handling, identical automotive components, in other words automotive components consisting in each case of the same material and having in each case the same shape, have product properties that are identical in each case. These properties include not only the same zinc layer thicknesses but also identical characteristic values of the galvanized automotive components, since the latter have each been guided identically through the galvanizing bath.

A further advantage afforded by the invention as a result of the separation and singling, in accordance with the system and the method, is that zinc bumps can more easily be avoided. Provided for this purpose, in accordance with the system, is a stripping device subsequent to the emersion region, and in the case of one preferred embodiment of this concept of the invention, the handling means or the handling device is configured such that after emersion, all automotive components in the separated and singled out state are guided past the stripping device for the stripping of liquid zinc in an identical way. In the case of an alternative embodiment, but one which can also be realized in combination with the stripping device, provision is made for all automotive components in the separated and singled out state to be moved identically after emersion in such a way that drip edges and streaks of liquid zinc are removed, more particularly drip off and/or are spread uniformly over the automotive component surfaces. Through the invention, consequently, it is therefore possible for each individual automotive component to be guided in a defined way not only through the galvanizing bath but also to be guided either in a defined positioning, as for example an inclined attitude of the automotive component, and moved past one or more strippers, and/or for the automotive component to be moved, through specific rotational and/or steering movements after emersion, in such a way that zinc bumps are at least substantially avoided.

Moreover, the system of the invention preferably comprises a plurality of rinsing devices, optionally with a plurality of rinsing stages. Hence there is preferably a rinsing device provided subsequent to the degreasing device and/or subsequent to the surface treating device. Through the individual rinsing devices, it is ultimately ensured that the degreasing agents used in the degreasing device and/or the surface treatment agents used in the surface treating device are not entrained into the subsequent method stage.

In the case of one preferred development of the invention, the hot dip galvanizing device is followed by a cooling device, more particularly a quenching device, at which the automotive component after the hot dip galvanizing is cooled and/or quenched, respectively.

Furthermore, in particular subsequent to the cooling device, there may be an aftertreating device provided. The aftertreating device is used in particular for passivation, sealing or coloring of the galvanized automotive components. Alternatively, the aftertreating stage may encompass for example afterworking, more particularly the removal of impurities and/or the removal of zinc bumps. As observed above, however, the afterworking step in the case of the invention is reduced considerably relative to the method known in the prior art, and in some cases, indeed, is superfluous.

Furthermore, in the case of the invention, in accordance with the system and/or the method, the galvanizing bath comprises zinc and aluminum in a zinc/aluminum weight ratio in the range of 55-99.999:0.001-45, preferably 55-99.97:0.03-45, more particularly 60-98:2-40, preferably 70-96:4-30. Alternatively, or additionally, the galvanizing bath has the composition below, wherein the weight specifications are based on the galvanizing bath and all of the constituents of the composition in total result in 100 wt %:

(i) zinc, more particularly in amounts in the range from 55 to 99.999 wt %, preferably 60 to 98 wt %,
(ii) aluminum, more particularly in amounts in the range from 0.1 to 45 wt %, preferably 2 to 40 wt %,
(iii) optionally silicon, more particularly in amounts in the range from 0.0001 to 5 wt %, preferably 0.001 to 2 wt %,
(iv) optionally at least one further ingredient and/or optionally at least one impurity, more particularly from the group of the alkali metals such as sodium and/or potassium, alkaline earth metals such as calcium and/or magnesium and/or heavy metals such as cadmium, lead, antimony, bismuth, more particularly in total amounts in the range from 0.0001 to 10 wt %, preferably 0.001 to 5 wt %.

In connection with trials conducted it was found that in the case of zinc baths having the composition indicated above, it is possible to achieve very thin and very homogeneous coatings on the automotive component, these coatings also satisfying the exacting requirements with regard to automotive component quality in automotive engineering.

Alternatively, or additionally, the flux has the following composition, where the weight specifications are based on the flux and all of the constituents of the composition result in total in 100 wt %:

(i) zinc chloride ($ZnCl_2$), more particularly in amounts in the range from 50 to 95 wt %, preferably 58 to 80 wt %;
(ii) ammonium chloride ($NH_4Cl$), more particularly in amounts in the range from 5 to 50 wt %, preferably 7 to 42 wt %;
(iii) optionally at least one alkali metal salt and/or alkaline earth metal salt, preferably sodium chloride and/or potassium chloride, more particularly in total amounts in the range from 1 to 30 wt %, preferably 2 to 20 wt %;
(iv) optionally at least one metal chloride, preferably heavy metal chloride, more preferably selected from the group of nickel chloride ($NiCl_2$), manganese chloride ($MnCl_2$), lead chloride ($PbCl_2$), cobalt chloride ($CoCl_2$), tin chloride ($SnCl_2$), antimony chloride ($SbCl_3$) and/or bismuth chloride ($BiCl_3$), more particularly in total amounts in the range from 0.0001 to 20 wt %, preferably 0.001 to 10 wt %;
(v) optionally at least one further additive, preferably wetting agent and/or surfactant, more particularly in amounts in the range from 0.001 to 10 wt %, preferably 0.01 to 5 wt %.

Alternatively or additionally, the flux application device, more particularly the flux bath of the flux application device, contains the flux in preferably aqueous solution, more particularly in amounts and/or in concentrations of the flux in the range from 200 to 700 g/l, more particularly 350 to 550 g/l, preferably 500 to 550 g/l, and/or the flux is used as a preferably aqueous solution, more particularly with amounts and/or concentrations of the flux in the range from 200 to 700 g/l, more particularly 350 to 550 g/l, preferably 500 to 550 g/l.

In trials with a flux in the aforesaid composition and/or concentration especially in conjunction with the above-described zinc/aluminum alloy, it was found that very low layer thicknesses, in particular of less than 20 μm, are obtained, this being associated with a low weight and reduced costs. Especially in the automotive sector, these are essential criteria.

Further features, advantages, and possible applications of the present invention are apparent from the description hereinafter of exemplary embodiments on the basis of the drawing, and from the drawing itself. Here, all features described and/or depicted, on their own or in any desired combination, constitute the subject matter of the present invention, irrespective of their subsumption in the claims or their dependency reference.

Figure 2:
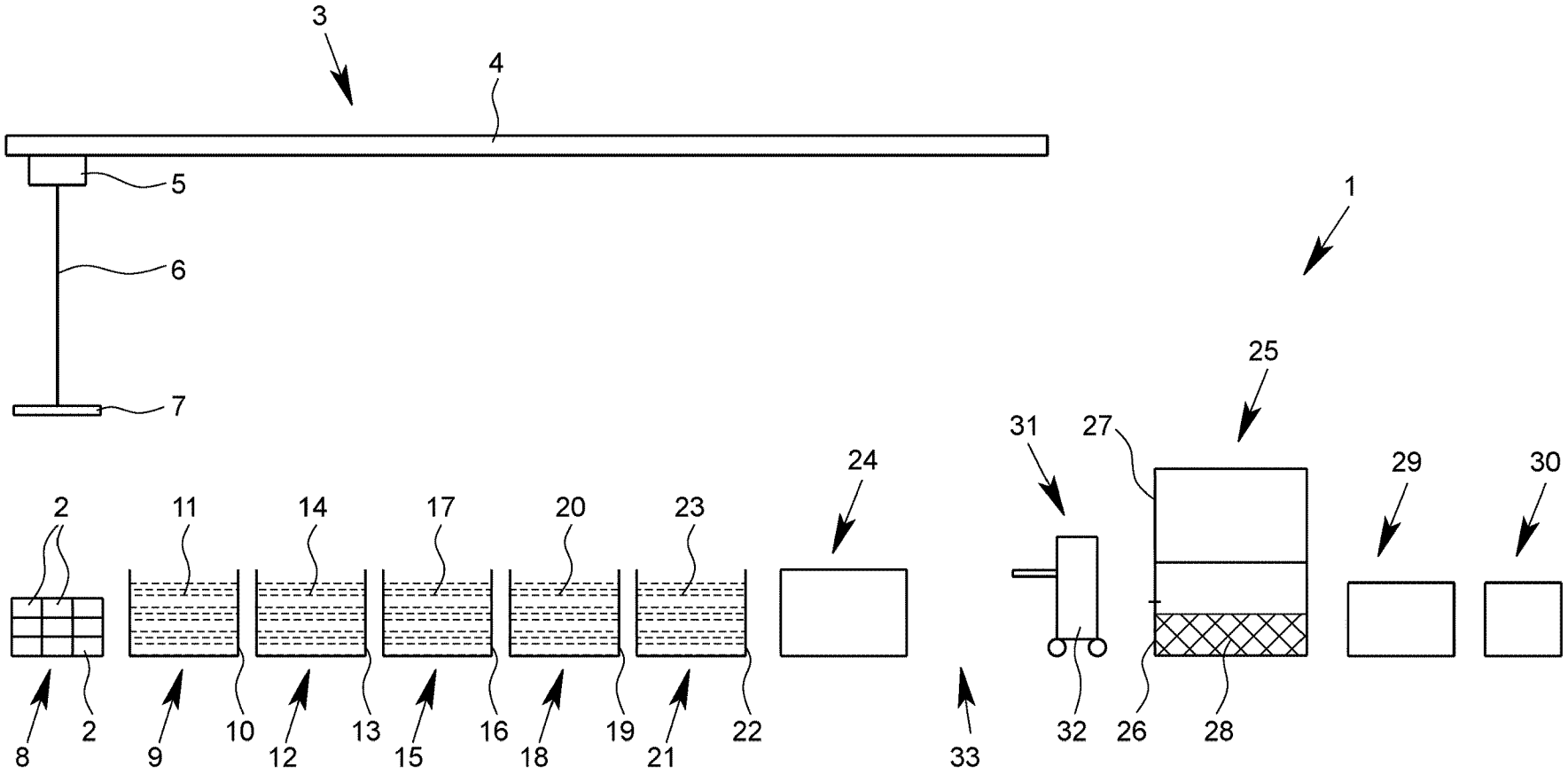
FIG. 2 shows a schematic representation of a system of the invention and of the sequence of the method of the invention in one method step.
Figure 3:
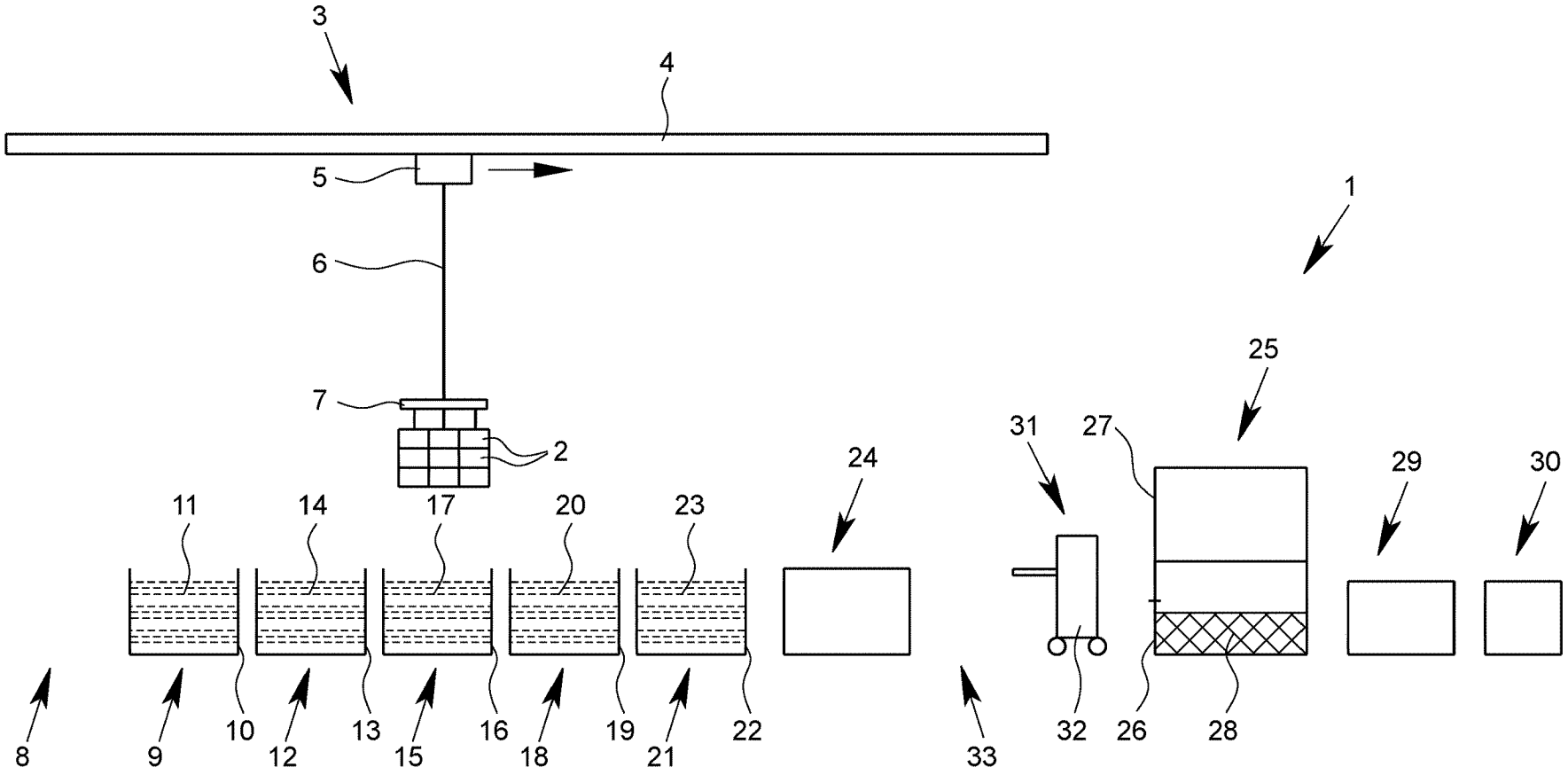
FIG. 3 shows a schematic representation of a system of the invention and of the sequence of the method of the invention in a further method step.
Figure 4:
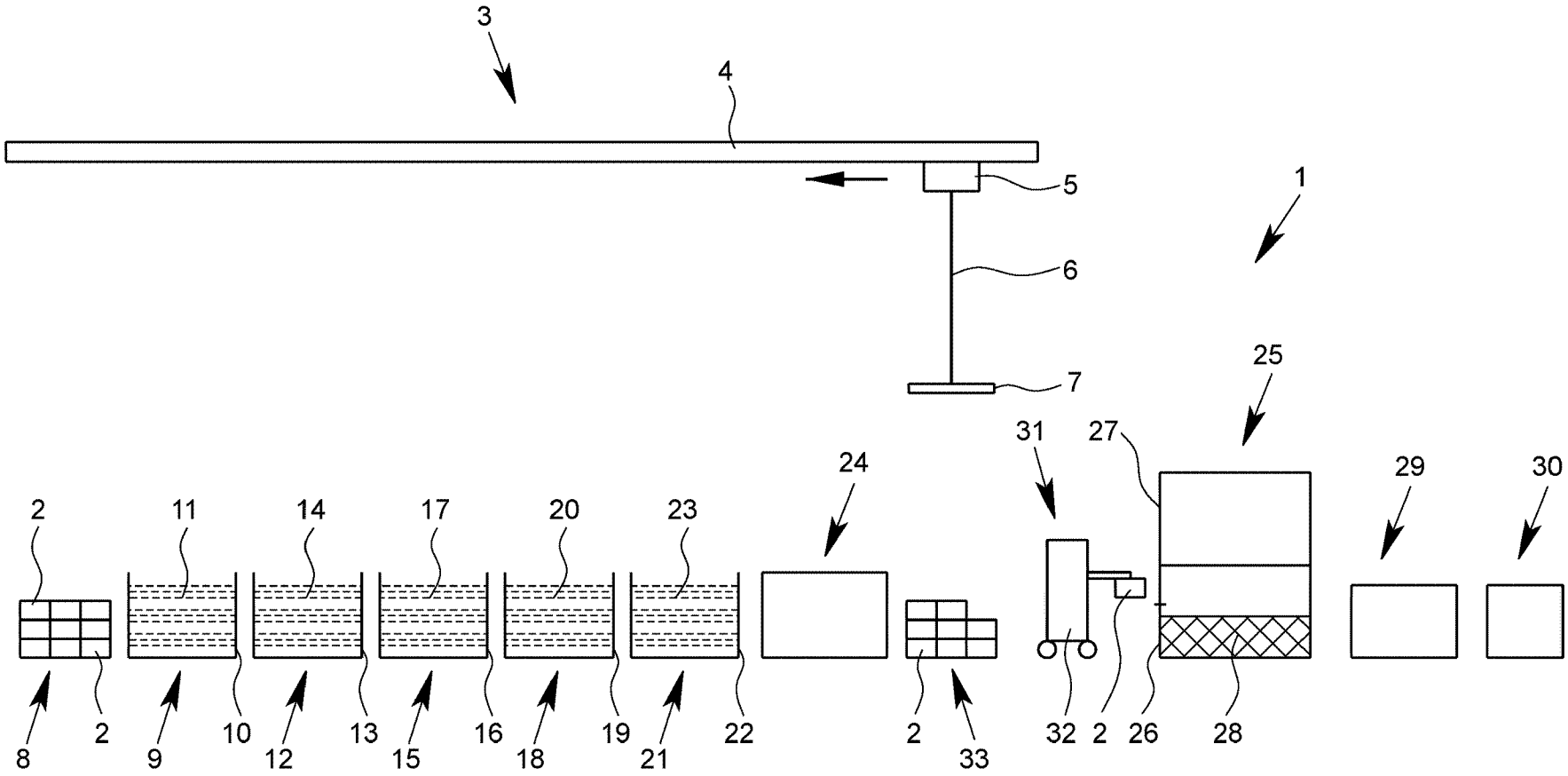
FIG. 4 shows a schematic representation of a system of the invention and of the sequence of the method of the invention in a further method step.
Figure 5:
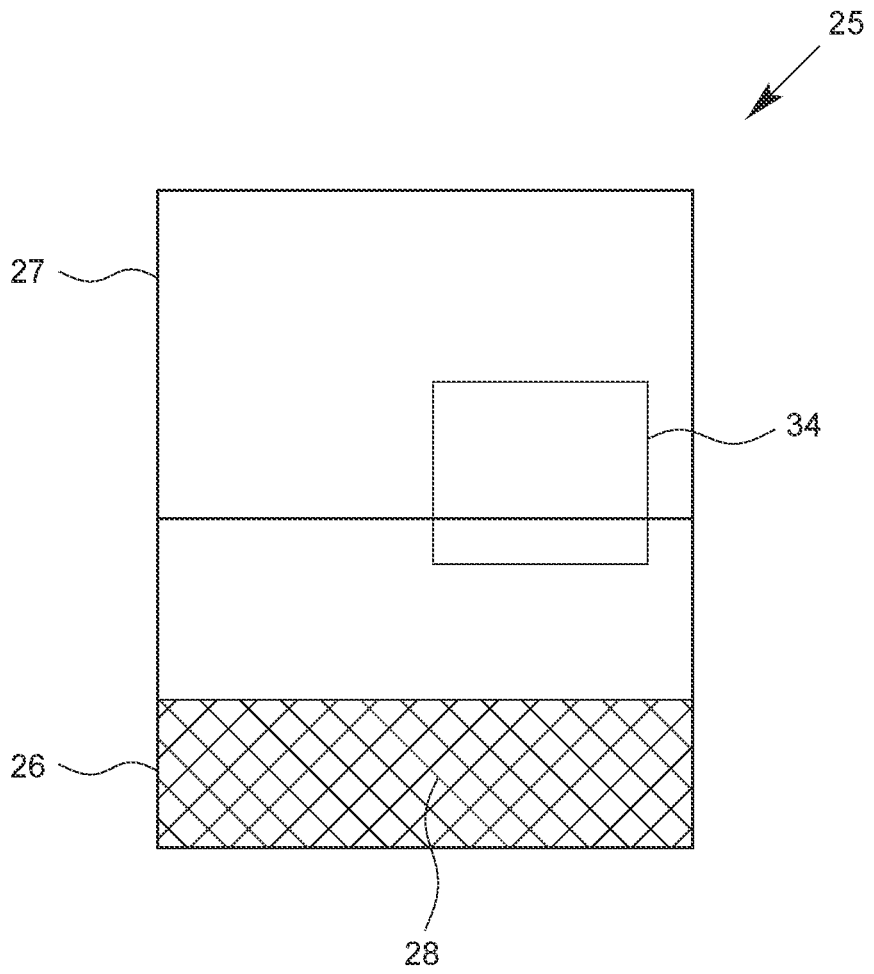
FIG. 5 shows a schematic representation of a system of the invention and of the sequence of the method of the invention in a further method step.
Figure 6A:
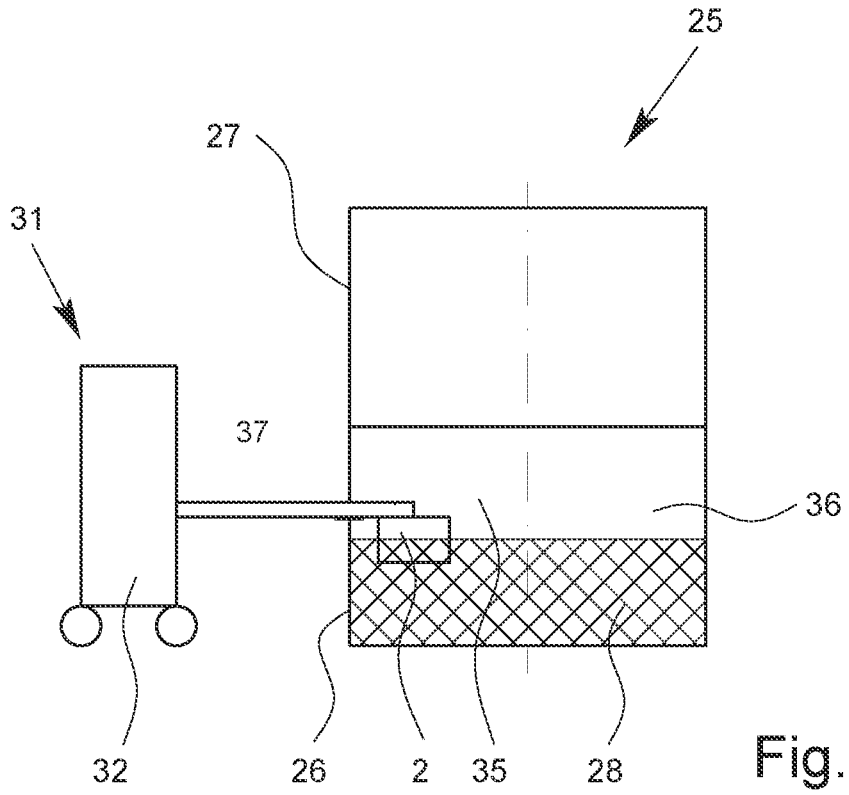
FIG. 6A shows a schematic representation of a system of the invention and of the sequence of the method of the invention in a further method step.
Figure 6B:
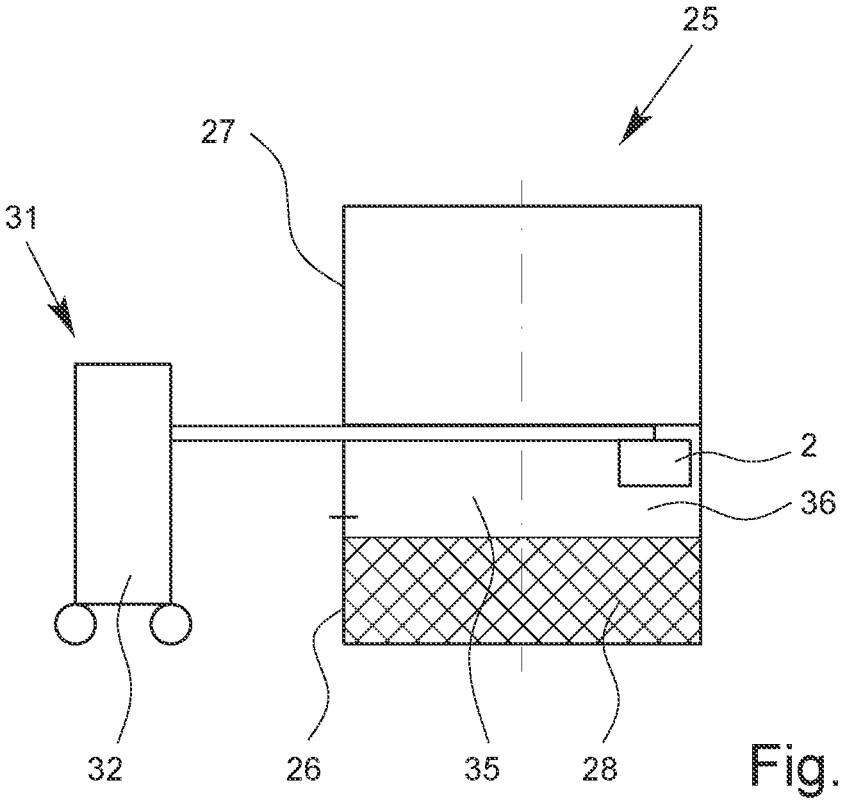
FIG. 6B shows a schematic representation of a system of the invention and of the sequence of the method of the invention in a further method step.

In the drawing:

FIG. 1 shows a schematic sequence of the individual stages of the method of the invention, FIG. 2 shows a schematic representation of a system of the invention and of the sequence of the method of the invention in one method step, FIG. 3 shows a schematic representation of a system of the invention and of the sequence of the method of the invention in a further method step, and FIG. 4 shows a schematic representation of a system of the invention and of the sequence of the method of the invention in a further method step.

In FIG. 1 there is a schematic representation of a sequence of the method of the invention in a system 1 of the invention. In this connection it should be pointed out that the sequence scheme shown is one method possible according to the invention, but individual method steps may also be omitted or provided in a different order from that represented and subsequently described. Further method steps may be provided as well. In any case, not all of the method stages need in principle be provided in one centralized system 1. The decentralized realization of individual method stages is also possible.

In the sequence scheme represented in FIG. 1, stage A identifies the supplying and the deposition of automotive components 2 for galvanization at a connection point. In the present example, the automotive components 2 have already been mechanically surface-treated, more particularly sandblasted. This is a possibility but not a necessity.

In stage B, the automotive components 2 are joined with a goods carrier 7 of a conveying device 3 to form a group of automotive components 2. In some cases, the automotive components 2 are also joined to one another and hence only indirectly to the goods carrier 7. It is also possible for the goods carrier 7 to comprise a basket, a rack or the like into which the automotive components 2 are placed.

In stage C, the automotive components 2 are degreased. This is done using alkaline or acidic degreasing agents 11, in order to eliminate residues of greases and oils on the components 2.

In stage D, the degreased automotive components 2 are rinsed, in particular with water. This washes off the residues of degreasing agent 11 from the automotive components 2.

In the method step E, the surfaces of the automotive components 2 undergo pickling, i.e. wet-chemical surface treatment. Pickling takes place customarily in dilute hydrochloric acid.

Stage E is followed by stage F, which is again a rinsing stage, in particular with water, in order to prevent the pickling agent being carried into the downstream method stages.

Then the correspondingly cleaned and pickled automotive components 2—still assembled as a group on the goods carrier 7—for galvanizing are fluxed, i.e. subjected to a flux treatment. The flux treatment in stage H likewise takes place presently in an aqueous flux solution. After a sufficient residence time in the flux 23, the goods carrier 7 with the automotive component 2 is passed on for drying in stage I in order to generate a solid flux film on the surface of the automotive components 2 and to remove adhering water.

In process step J, the automotive components 2, previously assembled as a group are separated and singled out, in other words taken from the group, and then further treated in the separated and singled out state. Separation and singling here may be accomplished by removing the automotive components 2 individually from the goods carrier 7 or else by the goods carrier 7 first depositing the group of automotive components 2 and then the automotive components 2 being taken individually from the group.

Following the separation and singling in step J, the automotive components 2 are then hot dip galvanized in the stage K. For this purpose, the automotive components 2 each individually are immersed into a galvanizing bath 28 and, after a specified residence time, emersed (removed) again.

The galvanizing in method step K is followed by dropping of the still liquid zinc in stage L. The dropping is for example accomplished by moving the automotive component 2, galvanized in the separated and singled out condition, along one or more strippers of a stripping device, or by specified pivoting and rotating movements of the automotive component 2, leading either to the dripping off or else to the uniform spreading of the zinc on the automotive component surface.

The galvanized automotive component is subsequently quenched in step M.

The quenching in method step M is followed by an aftertreatment in stage N, this aftertreatment possibly, for example, being a passivation, sealing, or organic or inorganic coating of the galvanized automotive component 2. The aftertreatment, however, also includes any afterwork possibly to be performed on the automotive component 2.

It should expressly be pointed out that in the case of exemplary embodiments not shown it is readily possible for the above-described method also to be carried out in such a way that a separated and singled out automotive component 2 or a small group in the form of a few automotive components, e.g., two or three automotive components, runs through the entire operation in the separated and singled out state, without any grouping or grouped treatment of automotive components during the operation. Hence it is possible for the automotive component 2 at the start of the method to be picked up by the conveying device 3 and guided through the individual method stages until it is taken over by a handling device 31 and supplied to the hot dip galvanizing stage. After the hot dip galvanizing, the galvanized automotive component can be supplied by the handling device 31 or else again by the conveying device 3 to the cooling device 29 and/or to the aftertreating device 30.

An alternative possibility is that, at the start of the overall operational sequence, a group of automotive components 2 is first transported via the conveying device 3 and separated and singled out after the degreasing and associated rinsing and/or after the surface treating and associated rinsing, after which the automotive components 2 in the separated and singled out state are then guided through the ongoing operation at least up to and including the hot dip galvanizing. Subsequently the automotive component 2, then galvanized, can be worked on further in the separated and singled out state or else grouped again and worked on further in the grouped state.

In FIGS. 2 to 4, an exemplary embodiment of a system 1 of the invention is represented schematically.

In FIGS. 2 to 4, in a schematic representation, one embodiment is depicted of a system 1 of the invention for the hot dip galvanizing of automotive components 2. The system 1 is intended for hot dip galvanizing a multiplicity of identical automotive components 2 in discontinuous operation, referred to as batch galvanizing. In particular, the system 1 is designed and suitable for the hot dip galvanizing of automotive components 2 in large-scale production. Large-scale galvanizing refers to galvanizing wherein more than 100, more particularly more than 1000, and preferably more than 10 000 identical automotive components 2 are galvanized in succession without interim galvanizing of automotive components 2 of different shape and size.

The system 1 comprises a conveying device 3 for conveying and/or for simultaneously transporting a plurality of automotive components 2 which are assembled to form a group. The conveying device 3 presently comprises a crane track with a rail guide 4, on which a trolley 5 with a lifting mechanism can be driven. A goods carrier 7 is connected to the trolley 5 via a lifting cable 6. The purpose of the goods carrier 7 is to hold and fasten the automotive components 2. The automotive components 2 are customarily joined to the goods carrier 7 at a connection point 8 in the system, at which the automotive components 2 are grouped for joining to the goods carrier 7.

The connection point 8 is followed by a degreasing device 9. The degreasing device 9 comprises a degreasing tank 10 in which there is a degreasing agent 11. The degreasing agent 11 may be acidic or basic. The degreasing device 9 is followed by a rinsing device 12, comprising a rinsing tank 13 with rinsing agent 14 located therein. The rinsing agent 14 presently is water. After the rinsing device 12, in other words downstream thereof in the process direction, is a surface treatment device configured as a pickling device 15 for the wet-chemical surface treatment of the automotive components 2. The pickling device 15 comprises pickling tank 16 with a pickling agent 17 located therein. The pickling agent 17, presently, is diluted hydrochloric acid.

Subsequent to the pickling device 15 there is, again, a rinsing device, 18, with rinsing tank 19 and rinsing agent 20 located therein. The rinsing agent 20 is again water.

Downstream of the rinsing device 18 in the process direction is a flux application device 21 comprising a flux tank 22 and flux 23 located therein. In a preferred embodiment, the flux comprises zinc chloride ($ZnCl_2$) in an amount of 58 to 80 wt % and also ammonium chloride ($NH_4Cl$) in the amount of 7 to 42 wt %. Furthermore, in a small amount, there may optionally be alkali metal salts and/or alkaline earth metal salts and also, optionally, in a comparatively further reduced amount, a heavy metal chloride. Additionally, there may optionally be a wetting agent in small amounts. It is understood that the aforesaid weight figures are based on the flux 23 and make up 100 wt % in the sum total of all constituents of the composition. Moreover, the flux 23 is present in aqueous solution, specifically at a concentration in the range from 500 to 550 g/l.

It should be pointed out that the aforesaid devices 9, 12, 15, 18, and 21 may in principle each have a plurality of tanks. These individual tanks, but also the tanks described previously, are disposed one after another in cascade fashion.

The flux application device 21 is followed by a drying device 24, for removal of adhering water from the film of flux located on the surface of the automotive components 2.

Furthermore, the system 1 comprises a hot dip galvanizing device 25, in which the automotive components 2 are hot dip galvanized. The hot dip galvanizing device 25 comprises a galvanizing tank 26, optionally with a housing 27 provided at the top. In the galvanizing tank 26 there is a galvanizing bath 28 comprising a zinc/aluminum alloy. Specifically, the galvanizing bath comprises 60 to 98 wt % of zinc and 2 to 40 wt % of aluminum. Furthermore, optionally, small amounts of silicon and, optionally in further-reduced proportions, a small amount of alkali metals and/or alkaline earth metals and also heavy metals are provided. It is understood here that the aforesaid weight figures are based on the galvanizing bath 28 and in total make up 100 wt % of all constituents of the composition.

Located after the hot dip galvanizing device 25 in the process direction is a cooling device 29 which is provided for quenching the automotive components 2 after the hot dip galvanizing. Finally, after the cooling device 29, an after-treating device 30 is provided, in which the hot dip galvanized automotive components 2 can be after-treated and/or afterworked.

Located between the drying device 24 and the hot dip galvanizing device 25 is a handling device 31, which is provided for the automated supplying, immersion, and emersion of an automotive component 2, separated and singled out from the goods carrier 7, into and from the galvanizing bath 28 of the hot dip galvanizing device 25. In the exemplary embodiment shown, the handling device 31 comprises a handling means 32 which is provided for the handling of the automotive components 2, specifically for removing an automotive component 2 from the group of automotive components 2 and/or for taking off the grouped automotive components 2 from the goods carrier 7, and also for the supplying, immersing, and emersing (removing) of the separated and singled out automotive component 2 into and from the galvanizing bath 28.

For the separation and singling, there is a transfer point 33 located between the handling means 32 and the drying device 24, and at this point 33 the automotive components 2 either are put down or else, in particular in the hanging condition, can be removed and/or can be separated and singled out from the goods carrier 7 and hence from the group. For this purpose, the handling means 32 is preferably configured such that it can be moved in the direction of and away from the transfer point 33 and/or can be moved in the direction of and away from the galvanizing device 25.

Moreover, the handling means 32 is configured such that it moves an automotive component 2, immersed separately into the galvanizing bath 28, from the immersion region to an adjacent emersion region and subsequently emerses it in the emersion region. The immersion region and the emersion region here are spaced apart from one another, i.e., do not correspond to one another. In particular, the two regions also do not overlap. The movement from the immersion region to the emersion region here takes place only after a specified period of time has expired, namely after the end of the reaction time of the flux 23 with the surface of the respective automotive components 2 for galvanizing.

Moreover, the handling device 31 centrally, and/or the handling means 32 locally, possess/possesses a control device, whereby the handling means 32 is moved such that all of the components 2 separated and singled out from the goods carrier 7 are guided through the galvanizing bath 28 with identical movement in identical arrangement, and with identical time.

Not depicted is the presence, above the galvanizing bath 28 and still within the housing 27, of a stripper of a stripping device (not shown), this stripper being intended for the stripping of liquid zinc. Moreover, the handling means 32 may also be controlled, via the assigned control device, in such a way that an automotive component 2 which has already been galvanized is moved, still within the housing 27, for example, by corresponding rotational movements, in such a way that excess zinc drips off and/or, alternatively, is spread uniformly over the automotive component surface.

FIGS. 2 to 4 then represent different conditions during operation of the system 1. FIG. 2 shows a condition wherein a multiplicity of automotive components 2 for galvanizing are deposited at the connection point 8. Above the group of automotive components 2 there is the goods carrier 7. After the goods carrier 7 has been lowered, the automotive components 2 are attached on the goods carrier 7. In the exemplary embodiment shown, the automotive components 2 are disposed in layers. In this case, all of the automotive components 7 may each be joined to the goods carrier 7. It is, however, also possible for only the upper layer of automotive components 2 to be joined to the goods carrier 7, while the following layer is joined to the layer above it. Another possibility is for the group of automotive components 2 to be disposed in a basketlike rack or the like.

In FIG. 3, the group of automotive components 2 is located above the pickling device 15. Stages C and D, namely the degreasing and rinsing, have already been performed.

In FIG. 4, the group of automotive components 2 has been deposited at the transfer point 33. The trolley 5 is on the way back to the connection point 8, at which there are already automotive components 2 present, as a group, to be newly galvanized. Of the group of automotive components 2 deposited at the transfer point 33, the handling means 32 has already withdrawn one automotive component 2, which is about to be supplied to the hot dip galvanizing device 25.

List of reference symbols:

| | |
|---|---|
| 1 | System |
| 2 | Automotive component |
| 3 | Conveying device |
| 4 | Rail guide |
| 5 | Trolley |
| 6 | Lifting cable |
| 7 | Goods carrier |
| 8 | Connection point |
| 9 | Degreasing device |
| 10 | Degreasing tank |
| 11 | Degreasing agent |
| 12 | Rinsing device |
| 13 | Rinsing tank |
| 14 | Rinsing agent |
| 15 | Pickling device |
| 16 | Pickling tank |
| 17 | Pickling agent |
| 18 | Rinsing device |
| 19 | Rinsing tank |
| 20 | Rinsing agent |
| 21 | Flux application device |
| 22 | Flux tank |
| 23 | Flux |
| 24 | Drying device |
| 25 | Hot dip galvanizing device |
| 26 | Galvanizing tank |
| 27 | Housing |
| 28 | Galvanizing bath |
| 29 | Cooling device |
| 30 | Aftertreating device |
| 31 | Handling device |
| 32 | Handling means |
| 33 | Transfer point |
| 34 | Stripping device |
| 35 | Immersion region |
| 36 | Emersion region |

The invention claimed is:

1. A hot-dip galvanizing method for the large-scale hot-dip galvanization of a multiplicity of identical or similar automotive components, using a zinc/aluminum alloy in a liquid molten form, wherein the method comprises the following steps:

a subgroup of automotive components, in a grouped state together with a plurality of further automotive components, are fastened on to at least one goods carrier of a conveying device, wherein the subgroup of automotive components are provided, on their surface, with a flux and wherein the subgroup of automotive components are then subjected to hot-dip galvanizing in a galvanizing bath comprising a zinc/aluminum alloy in a liquid molten form, wherein, for hot-dip galvanizing, the subgroup of automotive components are supplied, in a separated and singled out state, to the galvanizing bath, are then immersed therein and are subsequently emerged therefrom, wherein hot-dip galvanizing is carried out in the separated and singled out state of each of the subgroup of automotive components and wherein each single automotive component of the subgroup of automotive components, in a separated and singled out state, is immersed into an immersion region of the galvanizing bath, then moved from the immersion region to an adjacent emersion region and subsequently emerged in the emersion region.

2. The method as claimed in claim 1, wherein the automotive components, prior to the hot-dip galvanizing, are subjected to at least one of a degreasing treatment and a chemical, mechanical or chemical and mechanical surface-treatment.

3. The method as claimed in claim 2, wherein the automotive components, after the degreasing and surface-treatment, are rinsed and wherein the automotive components, after the hot-dip galvanizing, are cooled.

4. The method as claimed in claim 1, wherein a single automotive component, in the separated and singled out state, is moved from the immersion region to the emersion region only after the end of the reaction time of the flux with the zinc/aluminum alloy.

5. The method as claimed in claim 1, wherein all automotive components, in the separated and singled out state, are each guided in an identical way through the galvanizing bath.

6. The method as claimed in claim 1, wherein all automotive components, in the separated and singled out state, are each guided, after emersion, in an identical way past a stripping device for stripping off the liquid zinc/aluminum alloy.

7. The method as claimed in claim 1, wherein all automotive components, in the separated and singled out state, are each moved in an identical way after emersion such that drip edges and streaks of the liquid zinc/aluminum alloy are removed.

8. The method as claimed in claim 1, wherein all method steps or operations subsequent to the hot-dip galvanizing are carried out each in the separated and singled out state of the automotive component.

9. The method as claimed in claim 1, wherein the galvanizing bath comprises zinc and aluminum in a zinc/aluminum weight ratio in the range of from 55-99.999:0.001-45.

10. The method as claimed in claim 1, wherein the method is performed using a hot-dip galvanizing system for the large-scale hot-dip galvanization of the multiplicity of identical or similar automotive components comprising a hot-dip galvanizing device for hot-dip galvanizing the subgroup of automotive components, the device including:

a galvanizing bath comprising a zinc/aluminum alloy in a liquid molten form, a conveying device comprising at least one goods carrier for conveying the subgroup of automotive components to be fastened on the at least one goods carrier, and a flux application device for the application of a flux to the surface of the subgroup of automotive components, wherein the system further comprising a handling device for supplying, immersing and emersing a separated and singled out automotive component to, into and from the galvanizing bath comprising the zinc/aluminum alloy in a liquid molten form, wherein the handling device comprises at least one handling means disposed between the flux application device and the hot-dip galvanizing device, wherein the handling means is configured or equipped such that it separates and withdraws a singled out automotive component from the subgroup of automotive components and subsequently supplies it to the hot-dip galvanizing device for individual hot-dip galvanizing of the singled out the automotive components, and wherein the handling means is configured or equipped such that the singled out automotive component is immersed into an immersion region of the galvanizing bath, then moved from the immersion region to an adjacent emersion region and then emersed in the emersion region.

* * * * *